US007744203B2

(12) United States Patent
Takagi

(10) Patent No.: US 7,744,203 B2
(45) Date of Patent: Jun. 29, 2010

(54) NEEDLE AND MANUFACTURING METHOD THEREOF

(75) Inventor: Osamu Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 811 days.

(21) Appl. No.: 11/673,101

(22) Filed: Feb. 9, 2007

(65) Prior Publication Data

US 2007/0181184 A1 Aug. 9, 2007

(30) Foreign Application Priority Data

Feb. 9, 2006 (JP) ..... 2006-031936

(51) Int. Cl.
*B41J 2/175* (2006.01)

(52) U.S. Cl. ..... 347/86; 347/85; 347/103; 347/104

(58) Field of Classification Search ..... 347/85–86, 347/103–104
See application file for complete search history.

(56) References Cited

U.S. PATENT DOCUMENTS 5,488,401 A * 1/1996 Mochizuki et al. ..... 347/86
6,015,209 A * 1/2000 Barinaga et al. ..... 347/86
6,299,296 B2 * 10/2001 Gasvoda ..... 347/85
7,144,104 B2 * 12/2006 Katayama ..... 347/86
2005/0157109 A1 7/2005 Muranaka et al.
2007/0019048 A1 * 1/2007 Ito ..... 347/86

FOREIGN PATENT DOCUMENTS

JP H05-084924 A 4/1993
JP 411207982 A * 8/1999
JP 2005014437 A 1/2005

OTHER PUBLICATIONS

Japan Patent Office, Notice of Reasons for Rejection in priority Patent Application No. JP 2006-031936, mailed Aug. 26, 2008.

* cited by examiner

*Primary Examiner*—Charlie Peng
*Assistant Examiner*—Guy G Anderson
(74) *Attorney, Agent, or Firm*—Baker Botts L.L.P.

(57) ABSTRACT

The distance between an end of a contour of the curved area at which a straight line extending longitudinally of the pipe through the axis of the hole intersects with the contour of the curved area, and an end of the hole that is the nearest to the end of the contour of the curved area longitudinally of the pipe, is larger than the distance between an end of the contour of the curved area at which a straight line extending laterally of the pipe through the axis of the hole intersects with the contour of the curved area, and an end of the hole that is the nearest to the end of the contour of the curved area laterally of the pipe, when viewed along the central axis of the through hole.

7 Claims, 6 Drawing Sheets

NEEDLE AND MANUFACTURING METHOD THEREOF

BACKGROUND OF THE INVENTION

1. Field of the Invention

The present invention relates to a needle that pierces an elastic body, which is stopping a flow passage, so as to interconnect regions of the passage, which are separated by the elastic body; and also to a manufacturing method of the needle.

2. Description of Related Art

JP-A-2005-14437 discloses an ink cartridge having an ink bag to be filled with ink, and an image formation apparatus including therein the ink cartridge. The ink cartridge includes a supporting member thermally bonded to the ink bag. An ink inlet and an ink outlet are formed in the supporting member. An elastic body made of rubber is provided at an end of the ink outlet to tightly seal the ink outlet. The ink inlet is sealed by heat after the ink bag is filled with ink introduced through the ink inlet. The ink bag is thus kept in a state of being filled with ink. A hollow needle is provided in a main body of the image formation apparatus to introduce ink into the main body. The needle is formed into a tube having therein an ink introducing passage. A front end portion of the needle is tapered, and an ink introducing hole is formed on a side face of the front end portion. By sticking the needle into the elastic body of the ink cartridge, the ink introducing passage of the needle is connected through the ink introducing hole with the ink outlet of the supporting member, and thereby ink in the ink bag is supplied into the main body of the image formation apparatus.

In the above-described technique, when the needle is stuck in the elastic body, the elastic body enters, by its elastic restoring force, the ink introducing hole of the needle. When the needle is moved till its ink introducing hole, in which the elastic body has entered, reaches the ink outlet of the supporting member, a shear force is applied to the elastic body by the peripheral edge of the ink introducing hole of the needle so that the elastic body is scraped off. Scraped-off pieces of the elastic body are sent together with ink in the ink bag through the ink introducing hole of the needle into the main body of the image formation apparatus. The pieces of the elastic body cause an ink ejection trouble in an inkjet head.

SUMMARY OF THE INVENTION

An object of the present invention is to provide a needle capable of preventing an elastic body, which is stopping a flow passage, from being scraped off; and a manufacturing method of the needle.

According to a first aspect of the present invention, a needle pierces an elastic body, which is stopping a flow passage, so as to interconnect regions of the passage, which are separated by the elastic body. The needle includes a hollow pipe that pierces the elastic body. One longitudinal end of the hollow pipe is closed. The needle further includes a through hole formed through a wall of the hollow pipe; and a recessed curved area formed on the wall of the hollow pipe around the through hole. In the recessed curved area, the wall is bent such that outer and inner surfaces of the wall are the more inside of the hollow pipe along a central axis of the through hole, at the nearer position to the central axis. The recessed curved area is formed such that the distance between an end of a contour of the recessed curved area at which a straight line extending longitudinally of the hollow pipe through the central axis of the through hole intersects with the contour of the recessed curved area, and an end of the through hole that is the nearest to the end of the contour of the recessed curved area longitudinally of the hollow pipe, is larger than the distance between an end of the contour of the recessed curved area at which a straight line extending laterally of the hollow pipe through the central axis of the through hole intersects with the contour of the recessed curved area, and an end of the through hole that is the nearest to the end of the contour of the recessed curved area laterally of the hollow pipe, when viewed along the central axis of the through hole.

According to the first aspect of the invention, because the recessed curved area is provided around the through hole, the elastic body is hard to come into contact with an edge of the through hole when the needle is piercing the elastic body. Thus, the elastic body is prevented from being scraped off by the edge of the through hole. In addition, because the slope of the recessed curved area longitudinal of the hollow pipe is gentle, the needle can smoothly be stuck into the elastic body or pulled away from the elastic body. Further, because the wall of the hollow pipe is bent inward of the hollow pipe in the recessed curved area, this increases the strength of the hollow pipe. Therefore, even when the through hole has been formed on the hollow pipe, the strength of the hollow pipe is kept.

According to a second aspect of the present invention, a manufacturing method of a needle is provided. The needle pierces an elastic body, which is stopping a flow passage, so as to interconnect regions of the passage, which are separated by the elastic body. The method includes a through hole forming step of forming a through hole through a wall of a hollow pipe that pierces the elastic body. One longitudinal end of the hollow pipe is closed. The method further includes a recessed curved area forming step of forming, by press work, a recessed curved area on the wall of the hollow pipe around the through hole such that outer and inner surfaces of the wall are the more inside of the hollow pipe along a central axis of the through hole, at the nearer position to the central axis. In the recessed curved area forming step, the recessed curved area is formed such that the distance between an end of a contour of the recessed curved area at which a straight line extending longitudinally of the hollow pipe through the central axis of the through hole intersects with the contour of the recessed curved area, and an end of the through hole that is the nearest to the end of the contour of the recessed curved area longitudinally of the hollow pipe, is larger than the distance between an end of the contour of the recessed curved area at which a straight line extending laterally of the hollow pipe through the central axis of the through hole intersects with the contour of the recessed curved area, and an end of the through hole that is the nearest to the end of the contour of the recessed curved area laterally of the hollow pipe, when viewed along the central axis of the through hole.

According to the second aspect of the invention, the recessed curved area in which the wall of the hollow pipe is bent inward can easily be formed around the through hole by press work. In addition, because the recessed curved area is provided, the elastic body is hard to come into contact with an edge of the through hole when the needle is piercing the elastic body. Thus, the elastic body is prevented from being scraped off by the edge of the through hole. Further, because the slope of the recessed curved area longitudinal of the hollow pipe is gentle, the needle can smoothly be stuck into the elastic body or pulled away from the elastic body. Further, by forming the recessed curved area, because the wall of the hollow pipe is bent inward of the hollow pipe in the recessed curved area, this increases the strength of the hollow pipe. Therefore, even when the through hole has been formed on the hollow pipe, the strength of the hollow pipe is kept.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Hereinafter, a preferred embodiment of the present invention will be described with reference to drawings.

Figure 1:
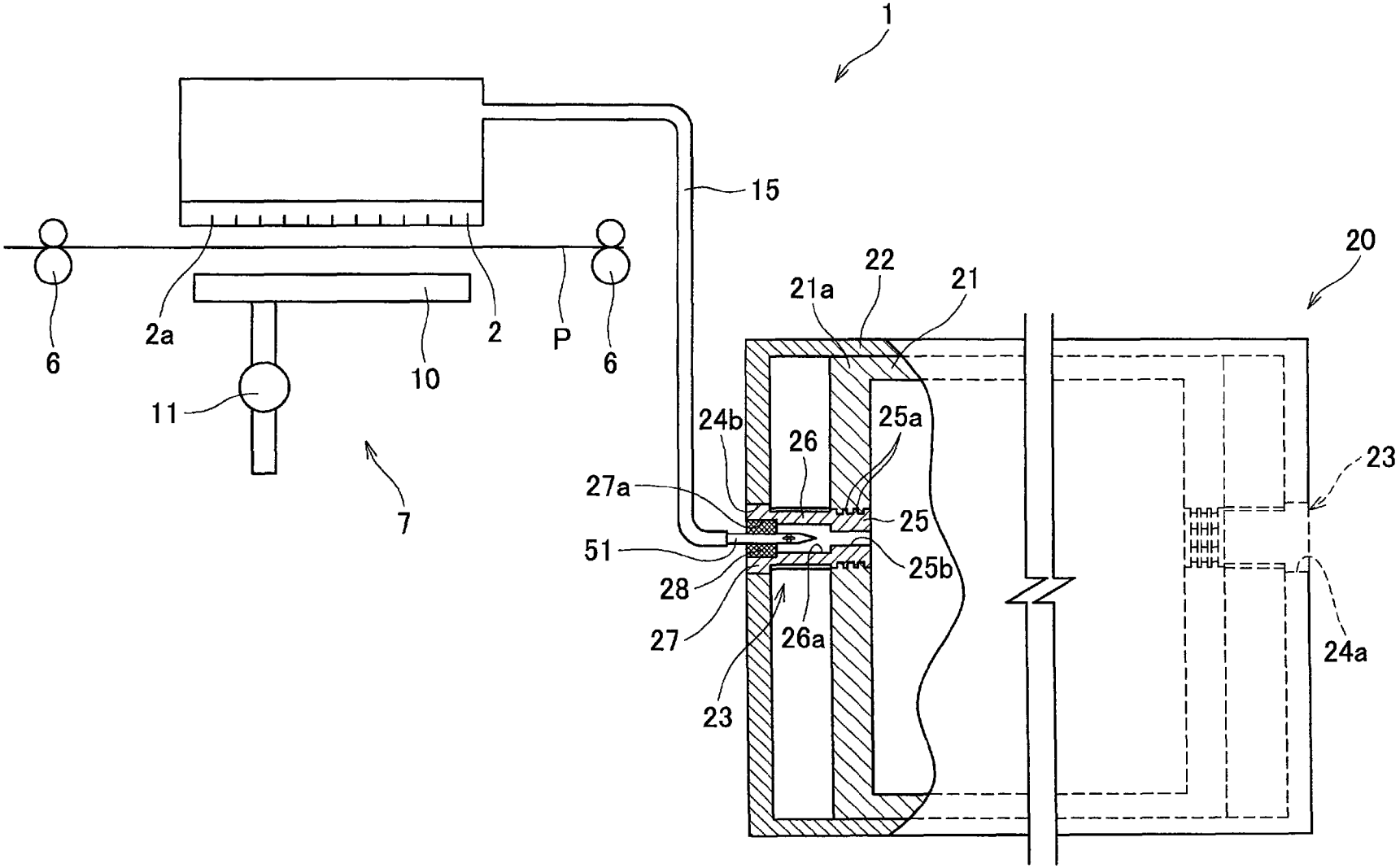
FIG. 1 shows a general construction of an inkjet printer according to an embodiment of the present invention.

FIG. 1 shows a general construction of an inkjet printer including therein a needle according to an embodiment of the present invention. As shown in FIG. 1, the inkjet printer 1 includes therein an inkjet head 2 having nozzles 2*a* for ejecting ink onto paper P for recording; an ink cartridge 20 connected to the inkjet head 2 through a flexible tube 15; a conveyance mechanism 6 for conveying the paper P; and a purge system 7 for sucking air and ink that has increased in viscosity, from the inkjet head 2.

The inkjet head 2 is a line type head extending perpendicularly to FIG. 1. Ink ejection openings of a large number of nozzles 2*a* are formed in a matrix on a lower face of the inkjet head 2. When printing on the paper P, the paper P is conveyed horizontally in FIG. 1 by the conveyance mechanism 6, and ink droplets are ejected from the nozzles 2*a*. The conveyance of the paper P and the ejection of ink droplets from the nozzles 2*a* are synchronized with each other by a not-shown controller so that ink droplets are ejected from the nozzles 2*a* for printing, each time when the paper P is conveyed by a predetermined distance. Ink is supplied to the inkjet head 2 from the ink cartridge 20 through the tube 15. In order to prevent ink from leaking out of the nozzles 2*a* when the nozzles 2*a* are not in operation for ink ejection, the nozzles 2*a* are disposed at a level higher than the ink cartridge 20.

The purge system 7 includes a purge cap 10 and a suction pump 11 for sucking ink from the nozzles 2*a*. The purge cap 10 can be moved so as to get near to and away from the ink ejection face of the inkjet head 2, and can be fitted on the ink ejection face of the inkjet head 2 so as to cover the ink ejection face. When the paper P is out of a printing region wherein printing can be performed on the paper P, a purge operation can be performed in which the suction pump 11 sucks, through the nozzles 2*a*, air that has entered in the inkjet head 2, and ink that has increased in viscosity due to evaporation of water. The purge operation restores the ink ejection performance of the inkjet head 2.

As shown in FIG. 1, the ink cartridge 20 includes an ink bag 21 filled with ink, and a housing 22 made of a synthetic resin and receiving therein the ink bag 21. The ink bag 21 contains therein ink in a degassed state. The ink bag 21 has two spouts 23 made of resin and disposed on the respective left and right sides of the ink bag 21 in FIG. 1. An ink inlet port 24*a* and an ink outlet port 24*b* are formed on the housing 22 so as to correspond to the respective spouts 23 of the ink bag 21. That is, one of the spouts 23 is disposed so as to correspond to the ink inlet port 24*a* on the right in FIG. 1. Ink is supplied from a not-shown ink injector into the ink bag 21 through the spout 23. The other spout 23 is disposed so as to correspond to the ink outlet port 24*b* on the left in FIG. 1. Ink is discharged from the ink bag 21 through the spout 23. These spouts 23 disposed at the respective ink inlet and outlet ports 24*a* and 24*b* have the same construction. As for the spouts 23, therefore, only the spout 23 disposed at the ink outlet port 24*b* will be described below.

The spout 23 is formed into a tube, and has a bonding area 25 to be thermally bonded to a peripheral edge 21*a* of the ink bag 21; a supporting area 27 to be supported by the housing 22; and a middle area 26 interconnecting the bonding area 25 and the supporting area 27. A number of protrusions 25*a* are formed on the outer circumferential surface of the bonding area 25. The spout 23 is united with the ink bag 21 by thermal bonding in a state wherein the protrusions 25*a* of the spout 23 interdigitate with the peripheral edge 21*a* of the ink bag 21. Thereby, a sealed state between the ink bag 21 and the spout 23 is ensured, and the spout 23 is connected with the interior of the ink bag 21.

A connection hole 25*b* is formed in the bonding area 25 to connect with the interior of the ink bag 21. A connection hole 26*a* is formed in the middle area 26. The connection hole 26*a* connects with the connection hole 25*b* and is larger than the connection hole 25*b* in diameter. A hole 27*a* is formed in the supporting area 27. The hole 27*a* connects with the connection hole 26*a* and the exterior of the spout 23 and is larger than the connection hole 26*a* in diameter. A cap 28 made of silicone or butyl rubber, as an elastic body, is fitted in the hole 27*a* of the supporting area 27. As shown in FIG. 1, the cap 28 allows a needle 51 to pierce, and thereby ink in the ink bag 21 can be supplied into an exterior flow passage, in this embodiment, the tube 15. When the ink in the bag 21 is run out, the needle 51 is pulled out from the cap 28 and the ink cartridge 20 is exchanged for another ink cartridge. The needle 51 is provided at an end of the tube 15 connected to the inkjet head 2, and thus the ink supplied into the tube 15 is further supplied in the inkjet head 2. Thus, when the needle 51 pierces the cap 28 as the elastic body that is stopping the flow passage, the connection holes 25*b* and 26*a* of the spout 23 and the ink bag 21 are connected with the tube 15 and the inkjet head 2 through a through hole 31 and a space 51*a*, which will be described later. That is, the needle 51 connects regions of the flow passage, which are separated by the cap 28, with each other.

The ink bag 21 is made of a laminate resin film in which several flexible films are put in layers by thermocompression. In the structure of the resin film, for example, a polypropylene layer is provided innermost. On the polypropylene layer, a polyester layer as a base body; an alumina or silica layer as a gas barrier layer disposed on the polyester layer; and a nylon layer for reinforcement of the film are put in layers in this order. Further, two resin films are provided outermost, and the peripheral edges 21*a* of the films are bonded to each other by thermocompression in a state wherein the edges sandwich the bonding area 25 of each spout 23. The ink bag 21 is thus formed that has the spouts 23 on the respective left and right peripheral edges 21*a* and can contain therein ink. Ink can be injected through the spout 23 disposed at the ink inlet port 24*a*, into a region in the ink bag 21 surrounded by its corresponding peripheral edge 21*a*. Ink can be discharged through the spout 23 disposed at the ink outlet port 24*b*, out of a region in the ink bag 21 surrounded by its corresponding peripheral edge 21*a*.

Figure 2A:
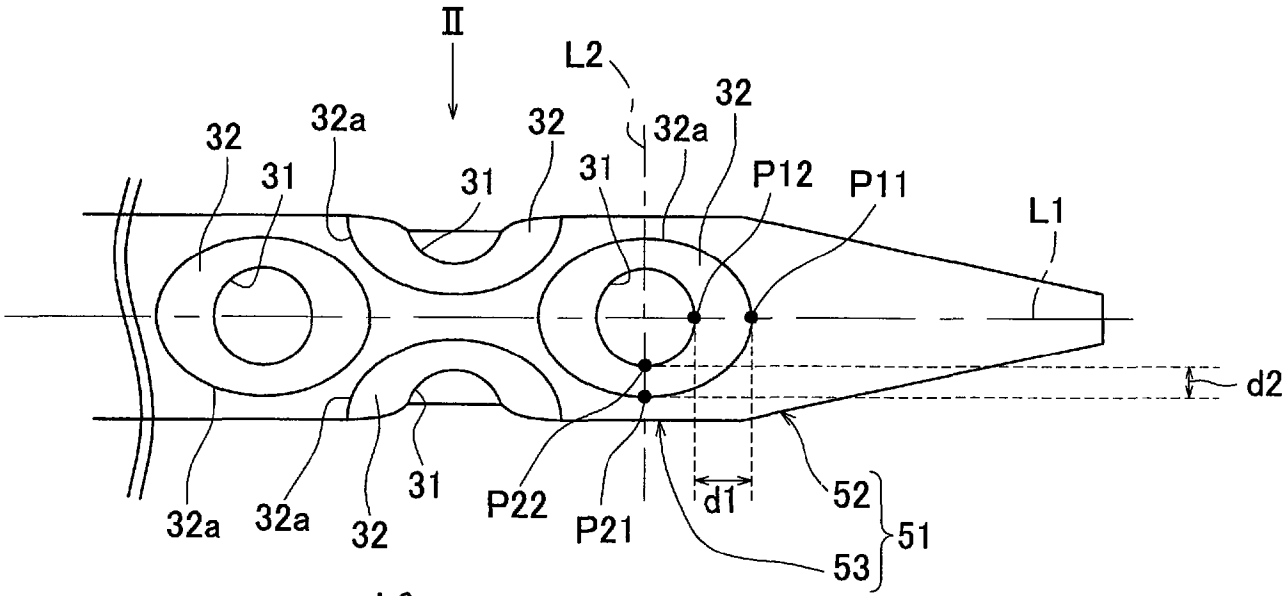
FIG. 2A is a plan view of a needle shown in FIG. 1 when viewed along a central axis of a through hole of the needle.
Figure 2B:
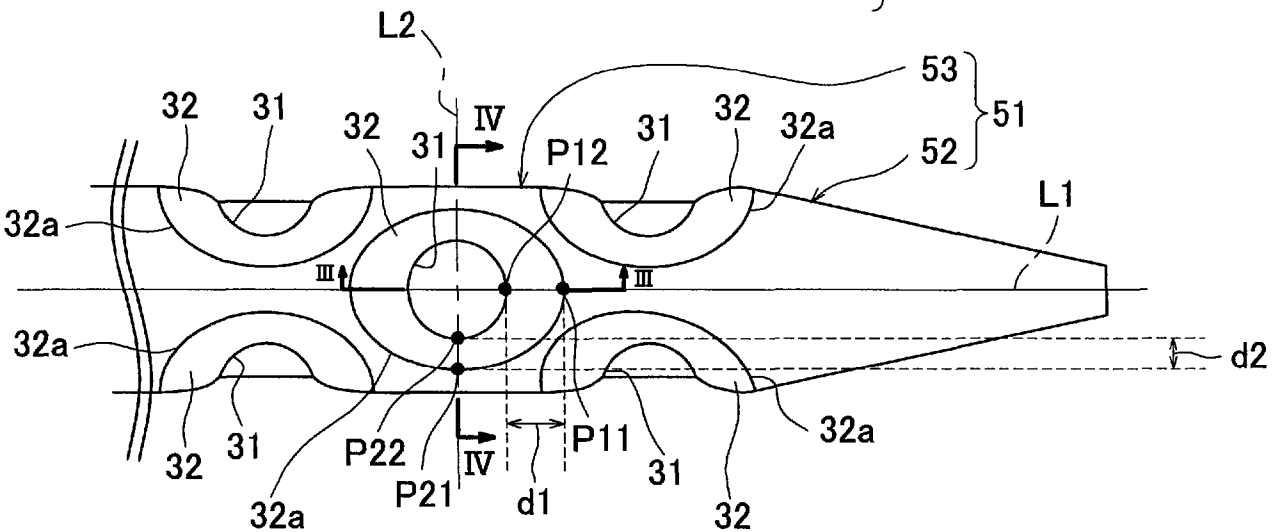
FIG. 2B is a plan view of the needle when viewed from a direction II in FIG. 2A.
Figure 3:
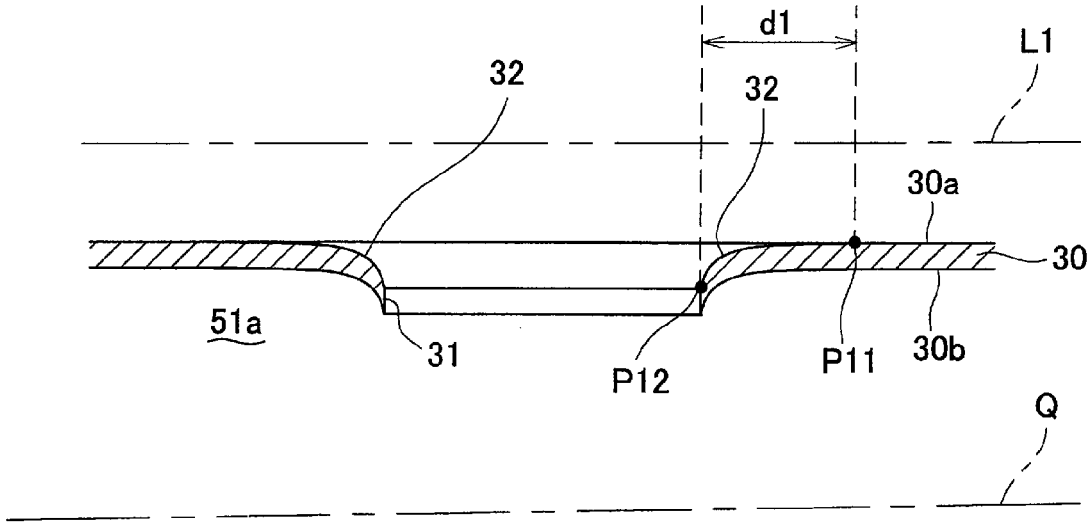
FIG. 3 is a sectional view taken along line III-III in FIG. 2B.
Figure 4:
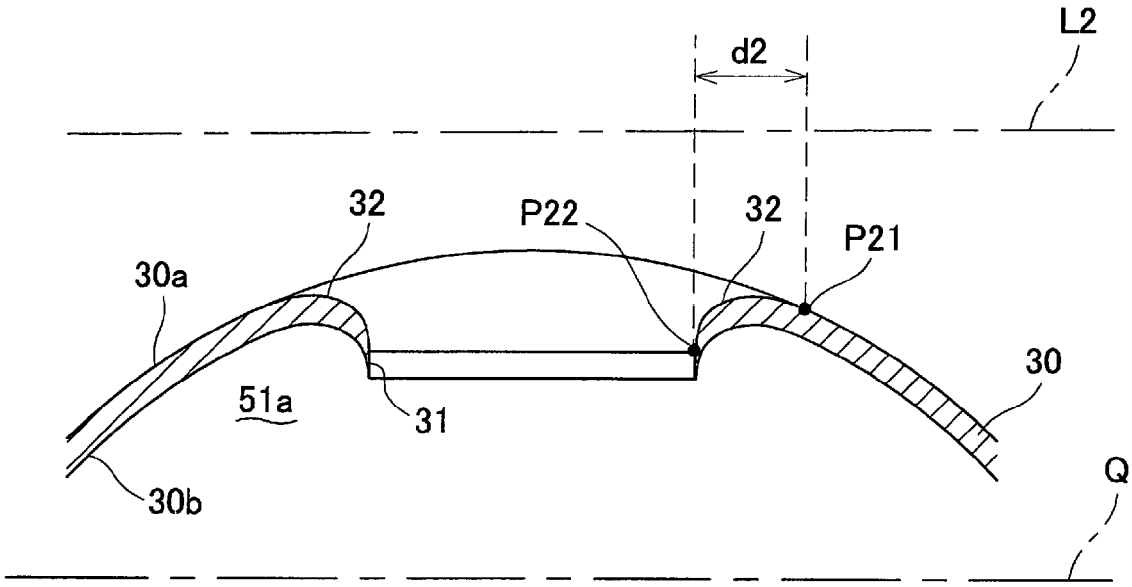
FIG. 4 is a sectional view taken along line IV-IV in FIG. 2B.

Next, the needle 51 will be described with reference to FIGS. 2 to 4. FIG. 2A is a plan view of the needle 51 shown in FIG. 1 when viewed along a central axis of a through hole 31 as will be described later. FIG. 2B is a side view of the needle 51 when viewed from the direction of an arrow II in FIG. 2A. FIG. 3 is a sectional view taken along line III-III in FIG. 2B. FIG. 4 is a sectional view taken along line IV-IV in FIG. 2B.

As shown in FIGS. 2 to 4, the needle 51 is formed into a hollow pipe circular in cross section. The needle 51 has therein a space 51*a* surrounded by a wall 30. The front end of the needle 51 is closed. The needle 51 has a tapered area 52 tapered toward the front end, and a substantially cylindrical straight area 53 extending longitudinally of the needle 51.

Six through holes 31 substantially circular in plan view are formed on the straight area 53. Each through hole 31 is formed through the wall 30 to connect the space 51*a* with the exterior of the needle 51. That is, when the needle 51 is stuck in the cap 28, the interior of the ink bag 21 is connected with the tube 15 through the through holes 31 and the space 51*a* of the needle 51.

Further, six recessed curved areas 32 are formed on the straight area 53 in regions surrounding the respective through holes 31. In each recessed curved area 32, the wall 30 is curved such that either of the nearer position of the outer and inner surfaces of the wall 30 to the central axis of the corresponding through hole 31 is the more inside of the needle 51, that is, the nearer to the center line of the space 51*a*.

As shown in FIGS. 2A and 2B, each recessed curved area 32 has its contour 32*a* of a substantially elliptical shape having its major axis extending longitudinally of the needle 51 and its minor axis extending laterally of the needle 51 when viewed along the central axis of the corresponding through hole 51. Each through hole 31 is formed substantially at the center of the corresponding recessed curved area 32, and the substantially circular contour of the through hole 31 is enclosed with the contour 32*a* of the recessed curved area 32. Therefore, when viewed along the central axis of the through hole 31, the distance d1 between an intersecting point P11 and a point P12 is larger than the distance d2 between an intersecting point P21 and a point P22. The intersecting point P11 is a intersecting point of a straight line L1 extending longitudinally of the needle 51 through the center of the through hole 31, with the contour 32*a* of the recessed curved area 32. That is, the intersecting point P11 is an end of the contour 32*a* intersecting with the straight line L1. The point P12 is a point at the end of the through hole 31 nearest to the point P11 longitudinally of the needle 51. The intersecting point P21 is an intersecting point of a straight line L2 extending laterally of the needle 51 through the center of the through hole 31, with the contour 32*a* of the recessed curved area 32. That is, The intersecting point P21 is an end of the contour 32*a* intersecting with the straight line L2. The point P22 is a point at the end of the through hole 31 nearest to the point P21 laterally of the needle 51. Thus, as shown in FIGS. 3 and 4, in each recessed curved area 32, the slope longitudinal of the needle 51, along which the needle 51 is stuck or pulled away, is gentler than the slope peripheral of the needle 51. Therefore, as will be described later, the needle 51 can smoothly be stuck into or pulled away from the cap 28.

Because the recessed curved areas 32 in which the wall 30 is curved inward of the needle 51 are thus formed on the straight area 53, each through hole 31 is distant from the cap 28 when the needle 51 pierces the cap 28. Thereby prevented is the cap 28 from being scraped off by an edge of the through hole 31 when the needle 51 is being stuck or pulled away, as will be described later. In this embodiment, as shown in FIGS. 3 and 4, in each recessed curved area 32, the slope of the outer surface 30*a* of the wall 30 relative to a plane Q perpendicular to the central axis of the corresponding through hole 31 is the steeper at the nearer position to the central axis of the through hole 31. In the recessed curved area 32, therefore, the rate of getting near to the center line of the space 51*a* along the central axis of the through hole 31 is the higher at the nearer position to the through hole 31. Thus, as will be described later, when the needle 51 pierces the cap 28, each through hole 31 is surely distant from the cap 28. This surely prevents a sharp edge of the through hole 31 from coming into direct contact with the cap 28 and thus from scraping off the cap 28 when the needle 51 pierces the cap 28. In addition, because the wall 30 of the needle 51 is curved inward of the needle 51 in each recessed curved area 32, this increases the strength of the needle 51. Therefore, even when the through holes 31 have been formed, a high strength can be kept.

In this embodiment, of the above-described six sets of through holes 31 and recessed curved areas 32, four sets are arranged so that two sets are arranged at positions shifted from the other two sets by 180 degrees peripherally of the needle 51, that is, along the periphery of the needle 51 perpendicular to a longitudinal axis of the needle 51, and each two sets are arranged longitudinally of the needle 51 at the positions corresponding to each other relatively to the periphery of the needle 51. The remaining two sets are arranged so that each set is disposed at a position peripheral of the needle 51, shifted by 90 degrees from the positions where the above four sets are formed. And the two sets are arranged so that each set is disposed at a position longitudinal of the needle 51, substantially in the middle of two of the above-described four sets arranged longitudinally of the needle 51. That is, the through holes 31 and the recessed curved areas 32 are arranged zigzag longitudinally and peripherally of the needle 51. Because the through holes 31 and the recessed curved areas 32 are thus arranged zigzag longitudinally and peripherally of the needle 51, the through holes 31 and the recessed curved areas 32 can be disposed at a high density.

Figure 5A:
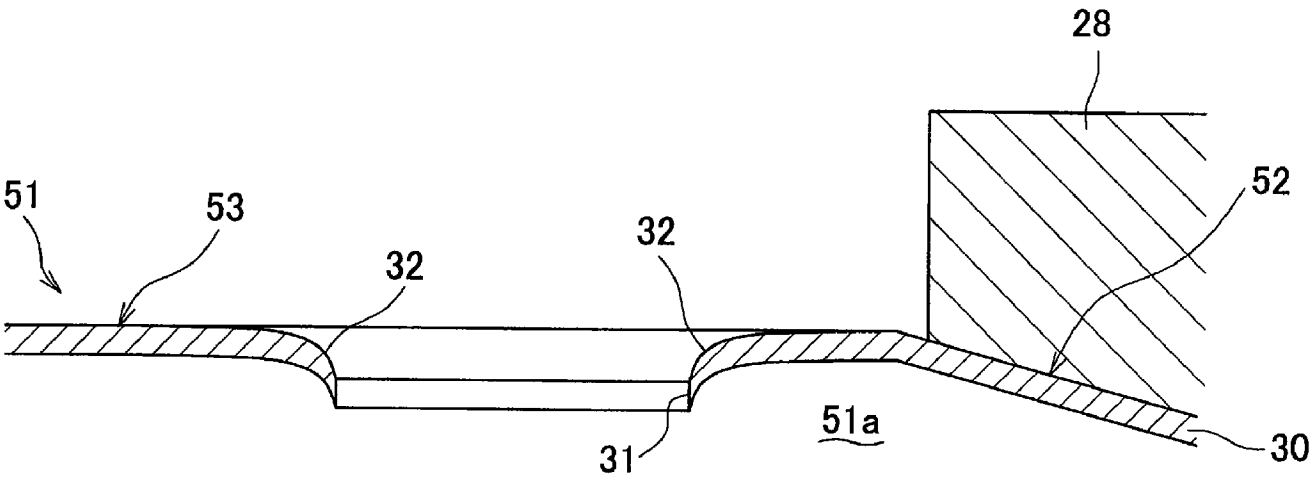
FIG. 5A shows a state wherein a tapered area of the needle is being stuck into a cap.
Figure 5B:
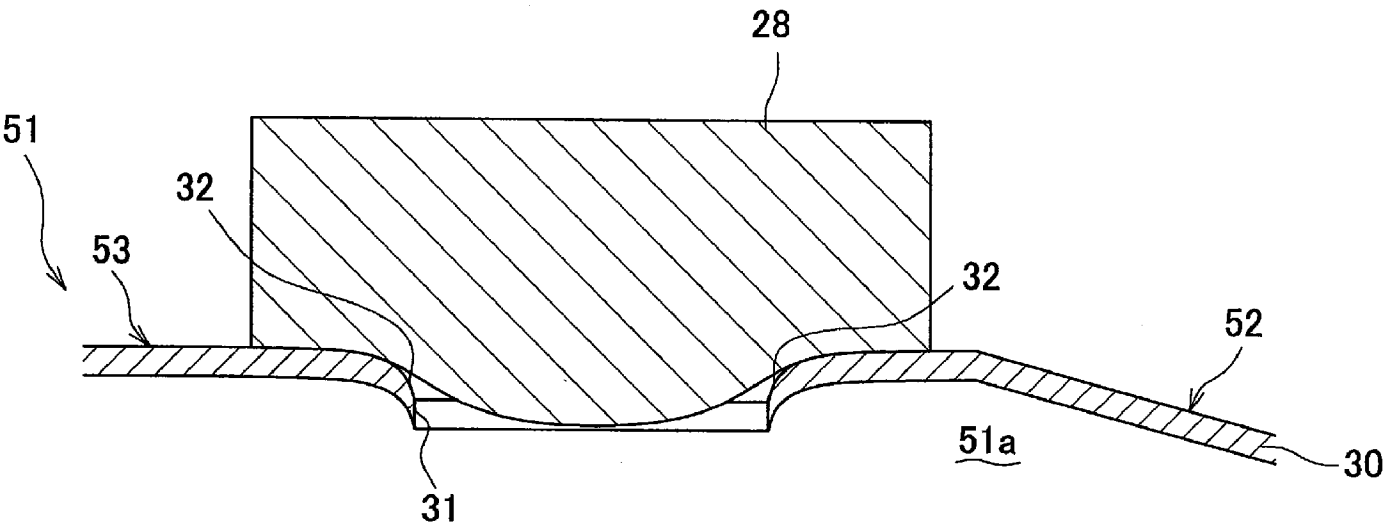
FIG. 5B shows a state wherein a through hole formed on a straight area of the needle has reached the cap.

Next, an operation of the needle 51 being stuck into the cap 28 will be described. FIG. 5A shows a state wherein the tapered area 52 of the needle 51 is being stuck into the cap 28. FIG. 5B shows a state wherein a through hole 31 formed on the straight area 53 of the needle 51 has reached the cap 28. To supply ink from the ink bag 21 of the ink cartridge 20 to the inkjet head 2, first, the front end of the needle 51 is stuck into the cap 28. At this time, as shown in FIG. 5A, because the tapered area 52 is tapered toward the front end, the front end of the needle 51 can easily be stuck into the cap 28. In addition, no through hole is formed on the tapered area 52. If a through hole is formed on the tapered area 52, the cap 28 is apt to enter the through hole by the elastic restoring force of the cap 28 when the tapered area 52 is stuck into the cap 28. If the needle 51 in which the cap 28 has entered the through hole is further moved rightward in FIG. 5A, the contact resistance between the cap 28 and the tapered area 52 increases because the cap 28 having entered the through hole can not smoothly follow the movement of the through hole. Further, a shear force is applied to the cap 28 by the through hole, and as a result, the cap 28 may be scraped off. Contrastingly in this embodiment, because no through hole is formed on the tapered area 52, the contact resistance between the tapered area 52 and the cap 28 is low even when the tapered area 52 is stuck into the cap 28. In addition, the cap 28 is not scraped off differently from the above case.

After the tapered area 52 of the needle 51 is stuck into the cap 28 as shown in FIG. 5A, the needle 51 is moved rightward. A through hole 31 formed on the straight area 53 then reaches the cap 28, and the cap 28 enters, by its elastic restoring force, the through hole 31, as shown in FIG. 5B. From this state, the needle 51 is further moved rightward in FIG. 5B till six through holes 31 enter the connection hole 26*a* of the spout 23 disposed at the ink inlet port 24*a*.

In this embodiment, because a recessed curved area 32 is formed in a region of the wall 30, forming the straight area 53, around each through hole 31, and thereby each through hole 31 is inside of the needle 51, the cap 28 having entered the through hole 31 does not come into contact with the edge of the through hole 31. Therefore, when the needle 51 is stuck into the cap 28, the cap 28 is not scraped off due to contact with the edge of the through hole 31. Thereby, it is prevented that scraped-off pieces of the cap 28 are sent from the through hole 31 through the space 51*a* and the tube 15 to the inkjet head 2 and a trouble in ejection of ink droplets arises in nozzles 2*a*. Further, in this embodiment, in each recessed curved area 32, the slope of the outer surface 30*a* of the wall 30 relative to the plane Q is the steeper at the nearer position to the central axis of the corresponding through hole 31 so that the rate of getting near to the center line of the space 51*a* along the central axis of the through hole 31 is the higher at the nearer position to the through hole 31. Therefore, each through hole 31 is further distant from the cap 28. This makes the cap 28 harder to be scraped off.

When a large amount of ink is supplied from the ink cartridge 20 to the inkjet head 2 for ejecting ink through a large number of nozzles 2*a* at once, a trouble in ejection of ink droplets due to scraped-off pieces of the cap 28 is in particular apt to arise. In this embodiment, however, even in such a case, because the cap 28 is hard to be scraped off by the needle 51, such a trouble in ejection of ink droplets is hard to arise.

Further, in each recessed curved area 32, because the slope longitudinal of the needle 51, along which the needle 51 is stuck or pulled away, is gentle, the needle 51 can smoothly be stuck. When the needle 51 stuck into the cap 28 is pulled away from the cap 28, the cap 28 is not scraped off due to contact of the cap 28 with the edge of each through hole 31, like the case that the needle 51 is stuck into the cap 28.

Figure 6A:
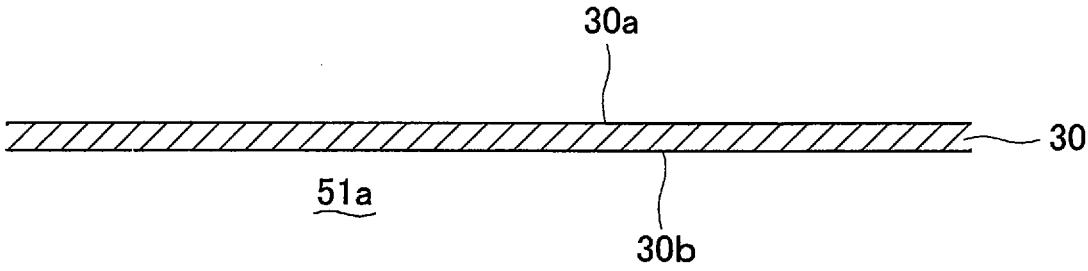
FIGS. 6A to 6C are sectional views showing manufacturing steps of the needle of FIG. 1.
Figure 6B:
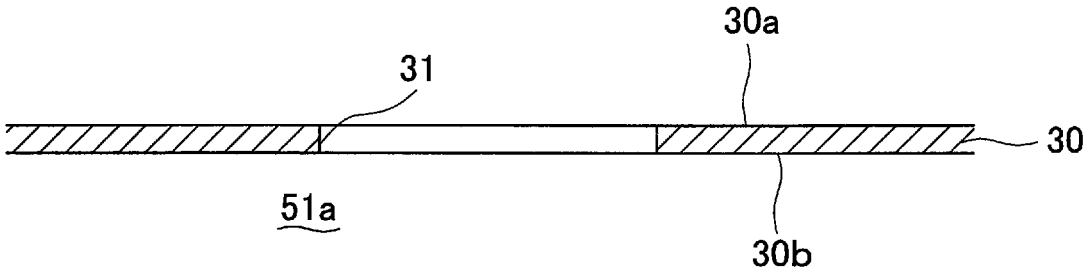
Figure 6C:
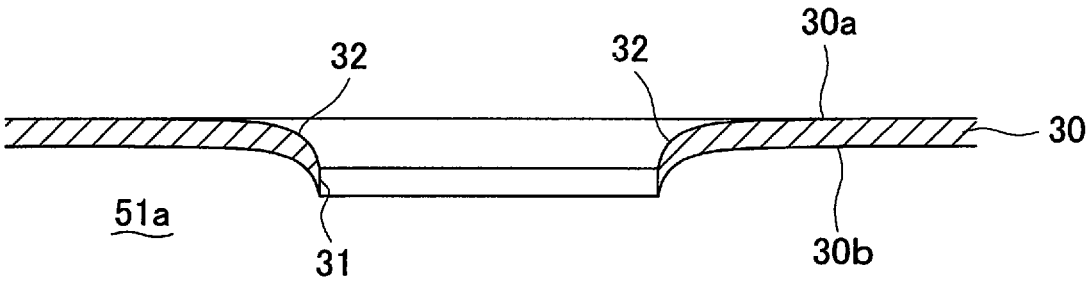

Next, a manufacturing method of the needle 51 will be described. FIGS. 6A to 6C show manufacturing steps of the needle 51 in sequence. To manufacture the needle 51, first, in a through hole forming step, a hollow pipe as shown in FIG. 6A, to be formed into the needle 51, in which a space 51*a* is formed, is prepared, and a through hole 31 is formed on a wall 30 of the hollow pipe by drilling or press work, for example, as shown in FIG. 6B. Next, in a recessed curved area forming step, a area of the wall 30 surrounding the through hole 31 is bent into the space 51*a* by press work to form a recessed curved area 32, as shown in FIG. 6C. A needle 51 is thus manufactured. Although only one set of a through hole 31 and a recessed curved area 32 is shown in FIGS. 6A to 6C, actually, six sets of through holes 31 and recessed curved areas 32 as shown in FIGS. 2A and 2B are formed in the same manner.

According to the above-described embodiment, a recessed curved area 32 is provided around each through hole 31. Therefore, when the needle 51 is piercing the cap 28, the cap 28 is hard to come into contact with the edge of each through hole 31. This prevents the cap 28 from being scraped off by the edge of the through hole 31.

In addition, in each recessed curved area 32, the slope of the outer surface 30*a* of the wall 30 relative to a plane Q perpendicular to the central axis of the corresponding through hole 31 is the steeper at the nearer position to the central axis of the through hole 31. In the recessed curved area 32, therefore, the rate of getting near to the center line of the space 51*a* along the central axis of the through hole 31 is the higher at the nearer position to the through hole 31. Thereby, when the needle 51 pierces the cap 28, each through hole 31 is more distant from the cap 28. This makes the cap 28 harder to come into contact with the edge of the through hole 31.

In addition, each recessed curved area 32 has its shape of an ellipse having its major axis extending longitudinally of the needle 51, and its minor axis extending laterally of the needle 51, when viewed along the central axis of the corresponding through hole 31. That is, when viewed along the central axis of the through hole 31, the distance d1 between the intersecting point P11 and the point P12 is larger than the distance d2 between the intersecting point P21 and the point P22. Therefore, the slope of each recessed curved area 32 longitudinal of the needle 51 is gentle. This realizes smooth operations of sticking and pulling away the needle 51.

Further, in each recessed curved area 32, the wall 30 is bent inward of the needle 51. This increases the strength of the needle 51, and the strength of the needle 51 is kept even when the though holes 31 have been formed.

Further, sets of recessed curved areas 32 and through holes 31 are arranged zigzag longitudinally and laterally of the needle 51. This realizes a high density arrangement of the recessed curved areas 32 and the through holes 31.

Further, the recessed curved areas 32 can easily be formed by press work.

In the embodiment, each recessed curved area 32 is formed such that the slope of the outer surface 30*a* of the wall 30 relative to the plane Q is the steeper at the nearer position to the central axis of the corresponding through hole 31. However, the present invention is not limited to that. For example, each recessed curved area 32 may be formed such that the slope of the outer surface 30*a* of the wall 30 relative to the plane Q is the gentler at the nearer position to the central axis of the corresponding through hole 31. Even in this case, in each recessed curved area, the wall 30 is curved so as to be the nearer to the center line of the space 51*a* at the nearer position to the central axis of the corresponding through hole 31, when viewed along the central axis. Therefore, like the embodiment, the cap 28 is hard to be scraped off by the edge of each through hole 31.

The shape of each recessed curved area, when viewed along the central axis of the corresponding through hole 31, is not limited to an ellipse as in the embodiment. Each recessed curved area can be formed into any other shape in which the distance between an intersecting point of the straight line L1 with the contour of the recessed curved area and the end of the corresponding through hole 31 nearest to the intersecting point, is larger than the distance between an intersecting point of the straight line L2 with the contour of the recessed curved area and the end of the corresponding through hole 31 nearest to the intersecting point, when viewed along the central axis of the corresponding through hole 31.

In the embodiment, the through holes 31 and the recessed curved areas 32 are arranged zigzag longitudinally and laterally of the needle 51. In a modification, however, they may be arranged zigzag only longitudinally or only laterally of the needle 51. In another modification, they may not be arranged zigzag.

In the embodiment, the needle 51 is provided in the inkjet printer 1. In a modification, however, such a needle 51 may be provided in an injector for injecting ink into the ink bag 21 of the ink cartridge 20. Also in the modification, the needle 51 is stuck into a cap 28 provided in the spout 23 at the ink inlet port 24*a* of the ink cartridge 20, and thereby ink is supplied from the injector into the ink bag 21. In this operation, the needle 51 is hard to scrape off the cap 28 in the spout 23. That is, the same effect as of the embodiment is obtained.

When the needle 51 itself is sufficiently slender, the tapered area 52 may not be provided. In this case, the needle 51 has only a straight area 53 whose front end is closed. In the embodiment, the needle 51 is circular in cross section. In a modification, however, the needle 51 is triangular, square, polygonal, or elliptical in cross section.

A needle 51 according to the embodiment may be used for another kind of apparatus than the injector for injecting ink into the ink bag 21, and the inkjet printer 1. That is, the present invention can be applied to any needle that pierces an elastic body, which is stopping a flow passage, so as to interconnect regions of the passage, which are separated by the elastic body.

In the embodiment, the through holes 31 are formed in the through hole forming step, and then the recessed curved areas 32 are formed in the recessed curved area forming step. In a modification, however, the recessed curved areas 32 may be formed simultaneously with the through holes 31 by press work. That is, the recessed curved area forming step may be performed simultaneously with the through hole forming step. In this case, because the through holes 31 and the recessed curved areas 32 can be formed in a single step, the manufacturing process of the needle 51 is simplified.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A needle that pierces an elastic body, which is stopping a flow passage, so as to interconnect regions of the passage, which are separated by the elastic body, the needle comprising:

a hollow pipe that pierces the elastic body, one longitudinal end of the hollow pipe being closed;

a through hole formed through a wall of the hollow pipe; and a recessed curved area formed on the wall of the hollow pipe around the through hole, the wall being bent in the recessed curved area such that outer and inner surfaces of the wall are the more inside of the hollow pipe along a central axis of the through hole, at the nearer position to the central axis, the recessed curved area being formed such that the distance between an end of a contour of the recessed curved area at which a straight line extending longitudinally of the hollow pipe through the central axis of the through hole intersects with the contour of the recessed curved area, and an end of the through hole that is the nearest to the end of the contour of the recessed curved area longitudinally of the hollow pipe, is larger than the distance between an end of the contour of the recessed curved area at which a straight line extending laterally of the hollow pipe through the central axis of the through hole intersects with the contour of the recessed curved area, and an end of the through hole that is the nearest to the end of the contour of the recessed curved area laterally of the hollow pipe, when viewed along the central axis of the through hole.

2. The needle according to claim 1, wherein the recessed curved area is formed such that a slope of the outer surface of the wall relative to a plane perpendicular to the central axis of the through hole is the steeper at the nearer position to the central axis of the through hole.

3. The needle according to claim 1, wherein the contour of the recessed curved area is substantially elliptical, having a major axis extending longitudinally of the hollow pipe and a minor axis extending laterally of the hollow pipe, when viewed along the central axis of the through hole.

4. The needle according to claim 1, wherein a plurality of through holes and a plurality of recessed curved areas are arranged zigzag longitudinally of the hollow pipe.

5. The needle according to claim 1, wherein a plurality of through holes and a plurality of recessed curved areas are arranged zigzag on a periphery of the hollow pipe perpendicularly to a longitudinal axis of the hollow pipe.

6. A manufacturing method of a needle that pierces an elastic body, which is stopping a flow passage, so as to interconnect regions of the passage, which are separated by the elastic body, the method comprising:

a through hole forming step of forming a through hole through a wall of a hollow pipe that pierces the elastic body, one longitudinal end of the hollow pipe being closed; and a recessed curved area forming step of forming, by press work, a recessed curved area on the wall of the hollow pipe around the through hole such that outer and inner surfaces of the wall are the more inside of the hollow pipe along a central axis of the through hole, at the nearer position to the central axis, the recessed curved area being formed in the recessed curved area forming step such that the distance between an end of a contour of the recessed curved area at which a straight line extending longitudinally of the hollow pipe through the central axis of the through hole intersects with the contour of the recessed curved area, and an end of the through hole that is the nearest to the end of the contour of the recessed curved area longitudinally of the hollow pipe, is larger than the distance between an end of the contour of the recessed curved area at which a straight line extending laterally of the hollow pipe through the central axis of the through hole intersects with the contour of the recessed curved area, and an end of the through hole that is the nearest to the end of the contour of the recessed curved area laterally of the hollow pipe, when viewed along the central axis of the through hole.

7. The method according to claim 6, wherein the through hole forming step and the recessed curved area forming step are performed at once by press work.

* * * * *